US008413801B2

(12) United States Patent
Justice

(10) Patent No.: US 8,413,801 B2
(45) **Date of Patent: *Apr. 9, 2013**

(54) LIDDED CONTAINER WITH A TEAR STRIP

(75) Inventor: Timothy J Justice, Williston, TN (US)

(73) Assignee: International Paper Company, Memphis, TN (US)

( * ) Notice: Subject to any disclaimer, the term of this patent is extended or adjusted under 35 U.S.C. 154(b) by 272 days.

This patent is subject to a terminal disclaimer.

(21) Appl. No.: 12/082,453

(22) Filed: Apr. 10, 2008

(65) Prior Publication Data

US 2008/0237070 A1 Oct. 2, 2008

Related U.S. Application Data

(63) Continuation-in-part of application No. 11/580,515, filed on Oct. 13, 2006, which is a continuation-in-part of application No. 11/445,446, filed on Jun. 1, 2006, now Pat. No. 7,798, 317.

(60) Provisional application No. 60/772,468, filed on Feb. 10, 2006, provisional application No. 60/698,156, filed on Jul. 11, 2005, provisional application No. 60/686,211, filed on Jun. 1, 2005, provisional application No. 60/922,633, filed on Apr. 10, 2007.

(51) Int. Cl.
*B42F 7/14* (2006.01)

(52) U.S. Cl. ..... 206/215; 229/117.24; 229/211; 229/123; 220/770

(58) Field of Classification Search ..... 206/215, 206/757, 766, 425, 555; 229/237, 117.24, 229/122, 125.19, 145, 134, 228, 924–926, 229/309, 227, 207, 123.2, 123.3, 200, 208, 210, 212, 238, 243, 235, 236, 240, 241, 242, 244, 125.33, 211, 117.22, 117.23, 123; 220/694, 220/752, 754, 755, 759, 760, 762, 767, 769, 220/770, 776, 768

See application file for complete search history.

(56) References Cited

U.S. PATENT DOCUMENTS

| | | | |
|---|---|---|---|
| 692,301 | A | 2/1902 | Kane |
| 1,057,145 | A | 3/1913 | Hagan |

(Continued)

FOREIGN PATENT DOCUMENTS

| | | |
|---|---|---|
| CH | 660345 | 4/1987 |
| DE | 8809938 | 11/1988 |

(Continued)

*Primary Examiner* — Jacob K Ackun
*Assistant Examiner* — Jenine Pagan
(74) *Attorney, Agent, or Firm* — Matthew M. Eslami

(57) ABSTRACT

An easy to carry lightweight carton for shipping and storing cut paper and for providing rapid and easy access to the paper when the carton is opened. The carton has a base portion and a lid pivotally attached to the base portion. The lid has a tear strip being defined by two parallel successive rows of inclined cut lines. Each of the inclined cut lines having a length (K) and further being spaced apart by a distance (D) wherein the ratio of D/K is from 1:2 to 4:1. A front wall of the carton may be pivoted down when the lid is pivoted up to facilitate access to the contents of the carton for ease of unloading of paper from the carton. A carry handle is built into the lid to facilitate carrying of the carton. The carton may be re-closed after it is opened.

13 Claims, 9 Drawing Sheets

U.S. PATENT DOCUMENTS

| | | | | | |
|---|---|---|---|---|---|
| 1,724,636 | A | | 8/1929 | Bell | |
| 2,354,543 | A | * | 7/1944 | Ratcliff | 229/102 |
| 2,364,829 | A | * | 12/1944 | Tichenor | 229/165 |
| 2,639,082 | A | | 5/1953 | Goldsmith | |
| 2,680,558 | A | * | 6/1954 | Mai | 229/228 |
| 2,695,128 | A | | 11/1954 | Rendall | |
| 2,795,369 | A | | 6/1957 | Caster et al. | |
| 3,040,957 | A | * | 6/1962 | Meyers | 229/228 |
| 3,065,897 | A | * | 11/1962 | Grapp | 229/241 |
| 3,109,577 | A | * | 11/1963 | Knipp | 229/228 |
| 3,146,936 | A | | 9/1964 | Hodapp | |
| 3,206,096 | A | | 9/1965 | Struble | |
| 3,216,645 | A | | 11/1965 | Hemann | |
| 3,231,172 | A | * | 1/1966 | Strange | 229/223 |
| 3,235,167 | A | | 2/1966 | Svensson | |
| 3,237,842 | A | | 3/1966 | Esse | |
| 3,307,770 | A | | 3/1967 | Wysocki | |
| 3,318,508 | A | * | 5/1967 | Buttery | 229/227 |
| 3,326,369 | A | | 6/1967 | Tolaas | |
| 3,361,328 | A | * | 1/1968 | Buttery | 229/227 |
| 3,372,856 | A | | 3/1968 | Erhart | |
| 3,542,281 | A | | 11/1970 | Field et al. | |
| 3,648,921 | A | * | 3/1972 | Lock | 229/222 |
| 3,684,158 | A | | 8/1972 | Harris | |
| 3,747,833 | A | * | 7/1973 | Robinson | 229/221 |
| 3,801,012 | A | | 4/1974 | Thelen | |
| 3,870,222 | A | | 3/1975 | Butler | |
| 3,963,173 | A | | 6/1976 | Stone | |
| 4,008,849 | A | * | 2/1977 | Baber | 229/237 |
| 4,066,205 | A | * | 1/1978 | Griffith | 229/221 |
| 4,113,102 | A | * | 9/1978 | Mueller | 229/237 |
| 4,295,599 | A | * | 10/1981 | Locatelli et al. | 206/737 |
| 4,386,705 | A | * | 6/1983 | Meuller | 229/205 |
| 4,498,620 | A | | 2/1985 | Dickert et al. | |
| 4,583,681 | A | | 4/1986 | Neese | |
| 4,637,544 | A | | 1/1987 | Quercetti | |
| 4,778,057 | A | | 10/1988 | Allen et al. | |
| 4,871,067 | A | | 10/1989 | Valenti | |
| 5,105,950 | A | * | 4/1992 | Gottfreid et al. | 229/210 |
| 5,198,276 | A | * | 3/1993 | Nakajima | 428/43 |
| 5,417,366 | A | * | 5/1995 | Hanko et al. | 229/227 |
| 5,439,168 | A | * | 8/1995 | Kim | 229/225 |
| 5,458,272 | A | | 10/1995 | Ward-Weber | |
| 5,505,372 | A | | 4/1996 | Edson et al. | |
| 5,622,309 | A | | 4/1997 | Matsuda et al. | |
| 5,657,872 | A | | 8/1997 | Leftwich et al. | |
| 5,738,274 | A | | 4/1998 | Stude | |
| 5,794,770 | A | * | 8/1998 | Plomgren et al. | 206/215 |
| 5,890,650 | A | * | 4/1999 | Penson | 229/243 |
| 6,016,911 | A | | 1/2000 | Chen | |
| 6,073,760 | A | * | 6/2000 | Roemer et al. | 206/215 |
| 6,332,538 | B1 | | 12/2001 | Pritchard | |
| 6,923,365 | B2 | | 8/2005 | Auclair et al. | |
| 7,066,321 | B2 | * | 6/2006 | Kawaguchi et al. | 206/77.1 |
| 7,367,490 | B2 | | 5/2008 | Forthaus et al. | |
| 7,798,317 | B2 | | 9/2010 | Justice et al. | |
| 2002/0000463 | A1 | | 1/2002 | Jaggi | |
| 2002/0134824 | A1 | * | 9/2002 | Mills | 229/122 |
| 2003/0116613 | A1 | | 6/2003 | McLeod et al. | |
| 2003/0226783 | A1 | | 12/2003 | Jackson et al. | |
| 2003/0234284 | A1 | | 12/2003 | Chiera | |
| 2004/0045857 | A1 | * | 3/2004 | Gillani | 206/459.5 |
| 2004/0124234 | A1 | | 7/2004 | Forthaus et al. | |
| 2004/0232039 | A1 | | 11/2004 | Daniels | |
| 2005/0011941 | A1 | | 1/2005 | Ruhbusch et al. | |
| 2005/0051573 | A1 | | 3/2005 | Crosland et al. | |
| 2006/0118605 | A1 | * | 6/2006 | Justice et al. | 229/117.13 |
| 2007/0199837 | A1 | | 8/2007 | Justice et al. | |
| 2008/0237070 | A1 | | 10/2008 | Justice | |
| 2011/0297561 | A1 | | 12/2011 | Justice | |

FOREIGN PATENT DOCUMENTS

| | | | |
|---|---|---|---|
| DE | 19918991 | | 11/2000 |
| DE | 102004006056 | | 9/2005 |
| EP | 0235852 | | 3/1991 |
| EP | 0235852 | | 4/1991 |
| EP | 0726205 | | 10/1998 |
| EP | 1136372 | | 9/2001 |
| EP | 1360116 | | 2/2006 |
| FR | 2579563 | | 2/1990 |
| GB | 2281065 | | 2/1995 |
| PL | 185153 | | 3/2003 |
| PL | 189871 | | 10/2004 |
| PL | 65832 | | 1/2011 |
| WO | WO 9533665 | A1 * | 12/1995 |
| WO | 2008124193 | | 10/2008 |

* cited by examiner

LIDDED CONTAINER WITH A TEAR STRIP

CROSS-REFERENCE TO RELATED APPLICATIONS

This application is a continuation-in-part of U.S. patent application Ser. No. 11/580,515, filed on Oct. 13, 2006; which in turn claims priority of U.S. application Ser. No. 11/445,446, filed Jun. 1, 2006, which in turn claims the benefit of U.S. provisional application Ser. No. 60/772,468, filed on 10 Feb. 2006, U.S. provisional patent application Ser. No. 60/698,156, filed on 11 Jul. 2005, and U.S. provisional patent application Ser. No. 60/686,211, filed on 1 Jun. 2005, and claims the benefit of U.S. provisional patent application Ser. No. 60/922,633, all of which are hereby incorporated hereinto by reference as if fully restated herein.

FIELD OF THE INVENTION

The present invention relates generally to a paperboard container for shipping, storing and handling a plurality of items such as, for example, paper products. More particularly, the invention relates to a shipping and storage carton for cut sheets of paper, wherein the carton has a size and weight to promote easy handling and storage and has a tear-strip to facilitate access to the paper. The carton may be reclosed after opening to keep unused paper fresh and neatly stacked, and has a built-in handle for ease and convenience in carrying the carton.

BACKGROUND OF THE INVENTION

Cut-sized paper, such as conventional photocopy paper, typically is wrapped in reams each containing, for example, 500 sheets. It is common for a plurality of reams to be bundled together and packaged in a corrugated container for shipping, storage and handling. For example, it is common to package from five to ten reams of paper in a single container, with a lid secured over the container to keep the reams from falling out of the container during shipping and handling. Since a single ream of paper weighs about five pounds, packages containing from five to ten reams of paper are heavy and difficult to handle. Moreover, they are relatively large and require substantial storage space. Further, the reams of paper are closely surrounded by the container walls, and the lack of space between the reams of paper and the container walls makes it difficult to remove the reams of paper for use. Additionally, each ream must be individually opened to gain access to the paper, and the ream wrap disposed of.

Single wrapped reams of paper also are commonly sold, and although these packages are easy to handle and store, they do not protect the paper from physical damage. Further, most equipment used in the home or in small offices does not hold a full ream of paper. Consequently, after a ream is opened and the desired amount of paper removed, the remaining unused paper is unprotected.

Many home and small office users prefer to purchase several reams of paper at once, rather than to buy single reams more frequently, but prefer not to buy as many as ten reams at once. Packages have been developed that hold five reams of paper, but even these packages are heavy, and, as such, are more suitable for industrial and commercial purchasers, which typically will have material handling equipment such as power lifts and hand carts to handle such heavy items. Average home users who wish to purchase several reams of paper at once typically do not have access to such material handling equipment.

Unwrapped cut sheets of paper are sometimes packaged loose in cartons designed to closely fit the paper and protect it from damage. Unwrapped cut sheets of paper do not require removal and discarding of ream wrap, but conventional cartons of this type generally are also sized to hold from five to ten reams of paper and thus are relatively difficult to handle and store. Moreover, these cartons generally have either a removable lid or foldable flaps to close the top of the carton, and the lid is removed or the flaps opened to form an open top through which product is removed from the carton. With such packaging it is difficult to remove the contents without damaging the carton or inverting it to pour the contents out because of the lack of space to insert the hands of the user between the side walls of the carton and the paper stored therein.

It is common practice to provide a tear strip in the corrugated container described hereinabove. In use, the tear-strip is gripped at one end thereof and pulled to tear it from a panel of a corrugated container. In many cases, removal of the tear-strip permits the corrugated container to hinge open. In others, more than one tear-strip may be used to provide for removal of a portion of a container. See U.S. Pat. Nos. 6,422,454; 3,863,834; 7,140,493; 5,487,506; 3,831,834; 3,712,531 & U.S. Pub. No. 2005/0051573; 2004/0232039, 2003/0234284, 2003/0116613, 2002/0166889. In general, the tear-strip comprises a pair of perforation lines running lengthwise or across a panel. The tear-strip has a tab at one end which is gripped by a user and pulled in an upward and forward direction to remove the tear-strip from the panel. Generally, when a user opens a container or carton or box having a tear-strip, occasionally, the tear-strip breaks and results an unattractive carton which is a problem if the end user intends on re-using the carton or keeping it around. Often a tear starts on the outer layer of the paperboard, and will tear at an angle all the way across the container or carton.

Therefore, it is desirable to provide a container or carton having a tear strip that overcome the aforementioned problem described hereinabove and to provide an aesthetically pleasing container or carton that removal of the tear-strip permits the corrugated container to hinge open.

It is also desirable to provide a carton for shipping and storing sheets of paper, such as photocopy paper or the like, which not only is smaller and lighter in weight than conventional multi-ream containers and accordingly is easier to handle and store, but which also protects the paper against physical damage from the environment.

It is also desirable to provide a carton that enables the sheets of paper to be easily and quickly unloaded from the carton, wherein the carton is adapted to remain sealed during shipping, handling and storing operations without the need to utilize ancillary securing devices such as straps and the like, and wherein the carton may be reclosed after opening.

In addition, it is desirable to provide an apparatus, such as a carry handle or the like, associated with the carton to facilitate handling thereof. A combination of a smaller multi-ream container together with a carry handle, for example, is ideally suited for retail sales to home users.

SUMMARY OF THE INVENTION

The present invention is directed to improve the tear-strip of a corrugated container when a user tears a corrugated container open using conventional tear-tape. Using a series of strategically placed cut lines along the tear-tape path, the user can effectively control the direction that the tearing travels, and therefore, prevent the breaks of the tear-strip.

The main advantage of the inclined cut lines is to improve the visual characteristics of the container/carton/box after it is opened using a tear-tape or a tear-strip. The inclined cut lines feature control the direction of the stress tear, keeping it back towards the tear-strip instead of across the carton surface. The inclined cut lines feature allows the tear to proceed in a very predictable manner to give an attractive edge and not compromise the structural integrity of the container/carton/box.

The present invention provides a container having a box-shaped main body portion and a lid that is sized and configured to fit over an open upper end of the main body. Sidewalls of the lid telescope over mating sidewalls of the main body and are adhered thereto, such as by adhesive or tape. One sidewall of the lid includes a tear-strip defined by two parallel inclined cut lines running along the length of the middle of the sidewall panel. One end of the tear-strip includes a tab for gripping by a user. Alternatively, a tear strip might be provided in additional sidewalls of the lid.

The present invention is directed to a paperboard container comprises a plurality of the panels folded with one another. The container comprises at least one panel comprising a tear-strip which comprises a pulling tab at one end. The tear-strip comprises at least two substantially parallel rows of a plurality of inclined cut lines extending along the least one panel. Each of the inclined cut lines comprises an initial end and a terminal end. The terminal end of the cut line is in spatial relation with the initial end of the adjacent cut line whereby a tear initiated at the terminal end of the cut line terminates at the initial end of the adjacent cut line in the direction of tear.

One aspect of the present invention is to provide a lidded container for shipping, storing and handling a plurality of items, such as, for example, prepackaged reams of paper and the like.

Another aspect of the present invention is to provide a lidded container wherein the lid is secured to the open upper end of the container main body without the use of straps, films or the like.

The present invention comprises a carton for shipping and storing cut sheets of paper, wherein the carton holds fewer sheets of paper than conventional containers for this purpose, and is therefore lightweight and easy to handle and store. The carton is constructed for easy access to the paper for unloading it from the carton, and is particularly adapted to ship and store unwrapped sheets of paper, although it may be adapted for shipping and storing individually wrapped reams of paper.

The carton includes a base portion having at least one side wall that may be pivoted downwardly to open the carton and expose the contents for easy removal, and a lid portion engaged over the base portion to close the top of the carton and normally hold the pivoted side wall in closed position. When the lid is opened, that side wall may be pivoted downwardly to expose the paper at the top and one side to facilitate access to it.

The openable side wall enables the user to easily and quickly grasp and unload the paper stored in the carton, without the necessity of forcing the hands or fingers between the carton side walls and the contents, or turning the carton over and dumping out the contents. Moreover, the lid and openable side wall may be reclosed to protect the paper remaining in the carton.

In a preferred embodiment the carton of the invention has a built-in carry handle and is adapted to hold more than one ream of paper, but less than the five or ten reams normally placed in a conventional package. For example, the carton of the invention is adapted to hold approximately three reams of paper, resulting in a lightweight package that is easy to handle. It is not intended, however, to limit the invention to a carton for holding three reams of paper. The carton can be adapted for any quantity of paper, but is generally limited to an amount that is easy to handle and store and that the built-in carry handle can reliably support, which generally does not substantially exceed three reams. After the carton is opened, the user may simply grasp and unload as many sheets as desired, without the need to open individual reams, and the carton may be reclosed to protect the unused sheets.

In a preferred construction, the base portion comprises a bottom wall, opposite end walls, and front and back walls folded from a single unitary blank of corrugated paperboard. End flaps on the back wall are folded inwardly and secured to the end walls by adhesive or other suitable fastening means so that the back wall and end walls remain in an upright position. End flaps or tuck-in flaps on the front wall are folded inwardly but are not attached to the end walls. Instead, they tuck in between the end walls and paper held in the carton, whereby the front wall can be pivoted downwardly to open the front of the carton. After the desired quantity of paper is removed from the carton, the front wall can be pivoted back up to an upright position, with the tuck-in flaps tucked between the end walls and paper to re-close the carton.

The lid portion comprises a lid folded from a single unitary blank, with an insert sheet and carry handle assembled to it. The lid has a top wall, depending end flanges, and depending front and back flanges. The depending front flange comprising a tear strip being defined by two parallel successive rows of inclined cut lines. Each of the inclined cut lines having a length (K) and further being spaced apart by a distance (D). The ratio of D/K is from 1:2 to 4:1. The back flange has end flaps on its opposite ends, turned inwardly to lie inside and parallel to the end flanges but unattached to the end flanges. In the assembled carton, the lid back flange and associated end flaps are secured by adhesive or other suitable fastening means to the back wall and end walls, respectively, of the base portion. The lid front flange has a width to extend downwardly over an upper edge portion of the base portion front wall, to hold the front wall in its upright closed position when the lid is in its operative closed position. End flaps on opposite ends of the front flange are turned inwardly to lay inside and parallel to the end flanges and are attached to the end flanges by adhesive or other suitable fastening means. A glue strip on the bottom edge of the lid front flange is secured by adhesive or other suitable fastening means to the base portion front wall, and a tear strip extends along the bottom edge of the front flange between the front flange and the glue strip. With this construction, when the tear strip is removed the lid may be pivoted upwardly to expose the paper held in the carton and uncover the front wall so that it may be pivoted downwardly to facilitate access to the paper.

A carry handle is attached to the lid to facilitate carrying the carton, and comprises a flexible strap attached to a base plate that is secured beneath an insert panel placed in the lid between the lid top wall and the top sheets of paper. The flexible strap extends through aligned openings in the insert panel and lid top wall. The insert panel may comprise corrugated cardboard, or chipboard, or other suitable material.

The carton of the invention may be opened to gain access to the paper stacked inside, and reclosed to protect the remaining paper. It does not require substantial adhesive attachment between the lid and the base, or separate securing means such as straps to keep the lid assembled to the base. Further, the carton preferably holds more than one ream of paper, preferably about three reams, and because of its reduced size and weight, and the provision of a carry handle, the carton is easy to carry and store.

BRIEF DESCRIPTION OF THE DRAWINGS

A better understanding of the invention will be had upon reference to the following description in conjunction with the accompanying drawings in which like reference numerals represent like parts, and wherein.

DETAILED DESCRIPTION OF THE PREFERRED EMBODIMENTS

Figure 1:
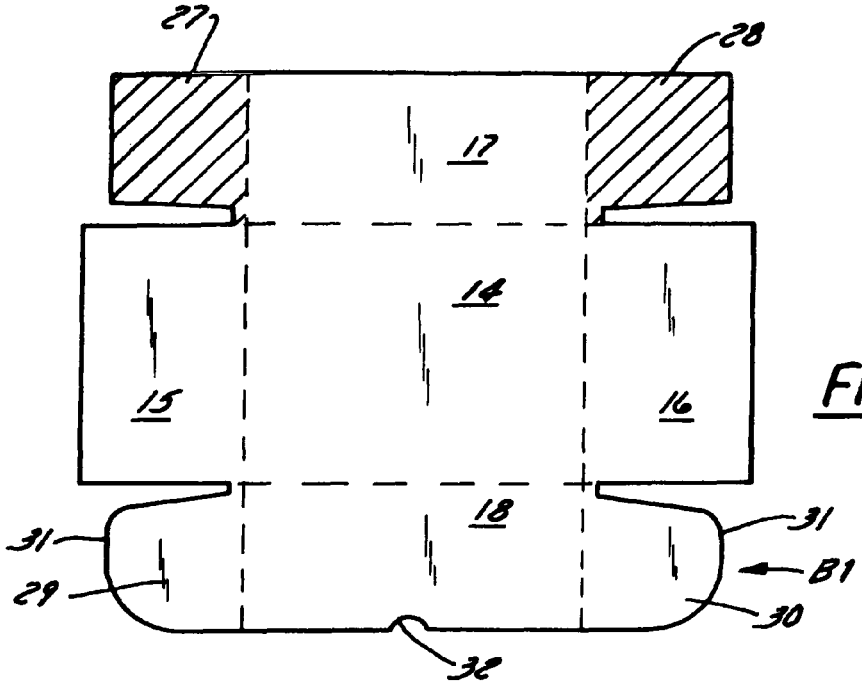
FIG. 1 is a plan view of the blank from which the carton base is formed.

A preferred carton in accordance with the invention is indicated generally at 10 in the drawings. The carton comprises a rectangularly shaped base portion 11, a lid portion 12, and a carry handle 13. The base portion has a bottom wall 14, opposite end walls 15 and 16, a back wall 17, a movable front wall 18, and an open top 19. The lid 12 is telescopically received over the open top and has a top wall 20, depending end flanges 21 and 22, a depending back flange 23, and a depending front flange 24. A glue strip 25 is joined to the bottom edge of the front flange to secure the front of the lid to the base portion front wall. A tear strip 26 extends between the front flange and glue strip to separate the front flange from the glue strip and enable the lid to be pivoted upwardly. The construction and usage of the tear strip 26 will be described in greater detail hereinafter.

Figure 6:
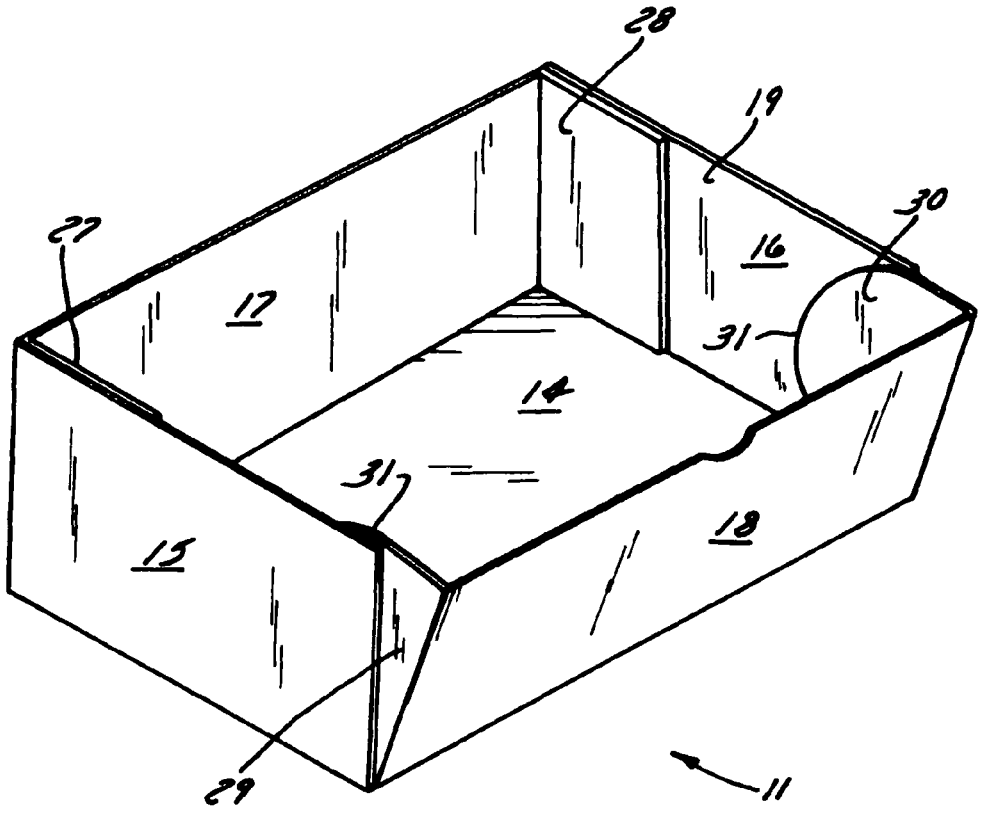
FIG. 6 is a top perspective view of the base portion of the carton of the invention, with the lid omitted and the front wall partially pivoted toward an open position.

Details of construction of the base portion 11 can be seen best with reference to FIGS. 1 and 6. A blank B1 for making the base portion 11 is illustrated in FIG. 1, and comprises bottom wall panel 14, opposite end wall panels 15 and 16 foldably joined to opposite ends of the bottom wall panel, back wall panel 17 foldably joined to a back edge of the bottom wall panel, and movable front wall panel 18 foldably joined to a front edge of the bottom wall panel. Glue flaps 27 and 28 are foldably joined to opposite ends of the back wall panel, and tuck-in flaps 29 and 30 are foldably joined to opposite ends of the front wall panel.

Assembly of the base portion 11 is seen best in FIG. 6. The glue flaps 27 and 28 on opposite ends of the back wall 17 are folded inwardly and glued or otherwise suitably fastened to the inner surface of the respective end walls 15 and 16, but the tuck-in flaps 29 and 30 on opposite ends of the front wall 18 are merely folded inwardly to lie against the inner surface of the end walls. The tuck-in flaps slide along the end walls, between the end walls and paper held in the carton, when the front wall 18 is moved between its upright and lowered pivoted positions. The tuck-in flaps may be suitably shaped, e.g., with a curvilinear free end edge 31 as shown, to facilitate entry of them into the space between the end walls and paper as the front wall is moved to its upright closed position. A finger access cut-out 32 may be provided in the upper edge of the front wall 18 to facilitate moving it downwardly, if desired.

Figure 2:
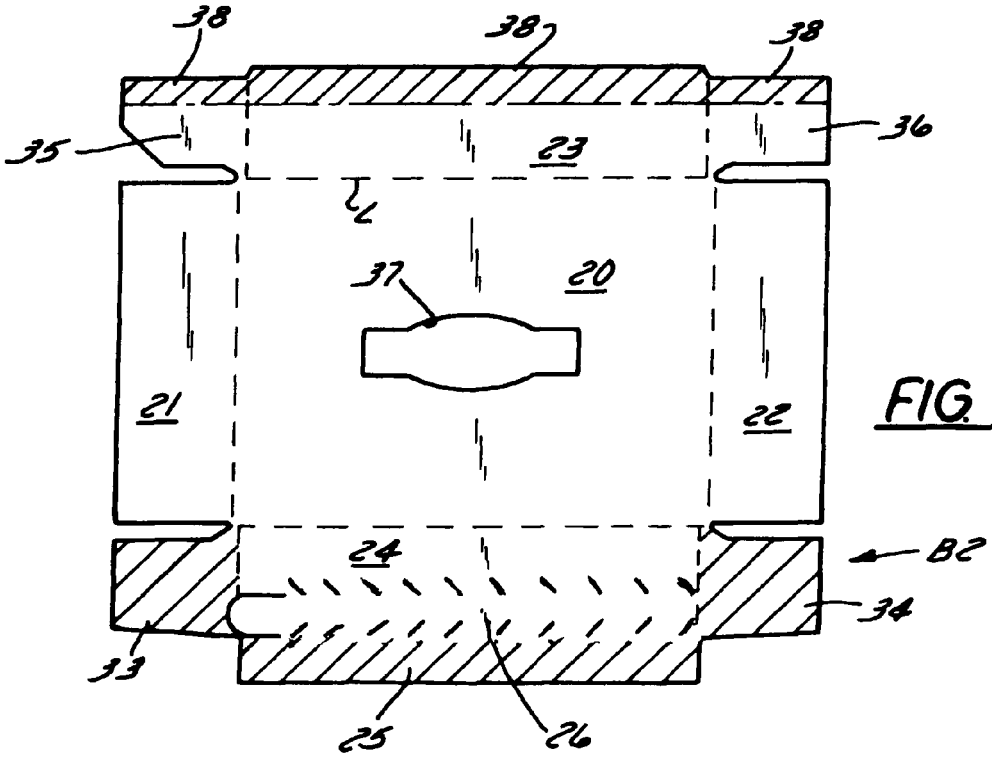
FIG. 2 is a plan view of the blank from which the lid is formed.

Details of construction of the lid portion 12 can be seen best with reference to FIGS. 2-5. A blank B2 for making the lid 12 is illustrated in FIG. 2, and comprises top wall panel 20, end flange panels 21 and 22 foldably joined to opposite ends of the top wall panel, back flange panel 23 foldably joined along fold line L to a back edge of the top wall panel, and front flange panel 24 foldably joined along a front edge of the top wall panel. Glue strip panel 25 is joined to the free edge of the front flange panel by tear strip 26 extending between the front flange and glue strip to enable separation of the front flange from the glue strip. First glue flaps 33 and 34 are foldably joined to opposite ends of the front flange panel 24, and second glue flaps 35 and 36 are foldably joined to opposite ends of the back flange panel 23. A shaped opening 37 is formed generally through the center of the top wall panel to receive the carry handle 13 as described below.

Figure 4:
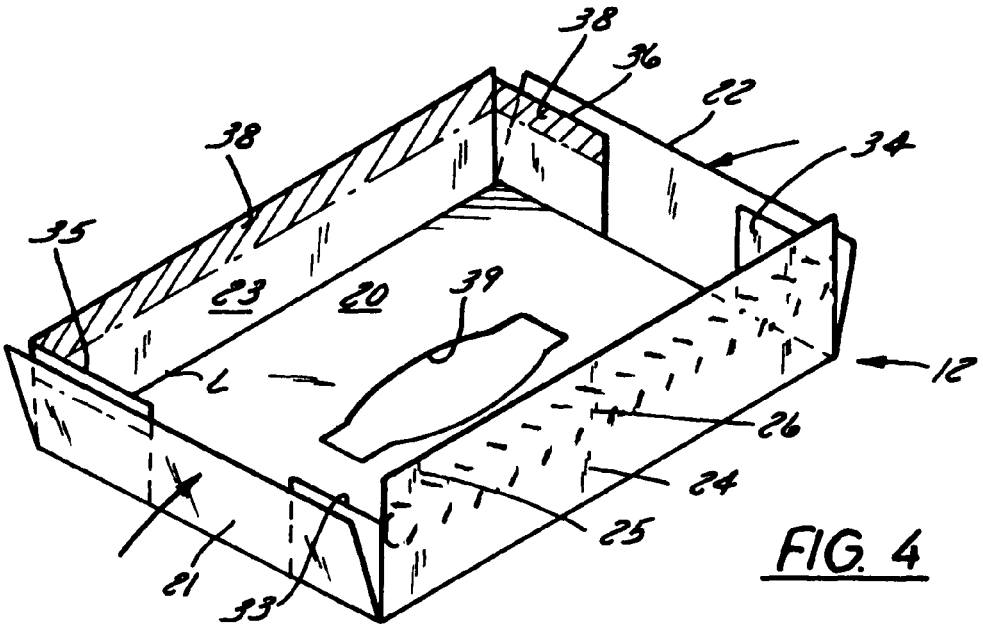
FIG. 4 is a perspective view of the lid in an inverted, upside-down position.
Figure 3:
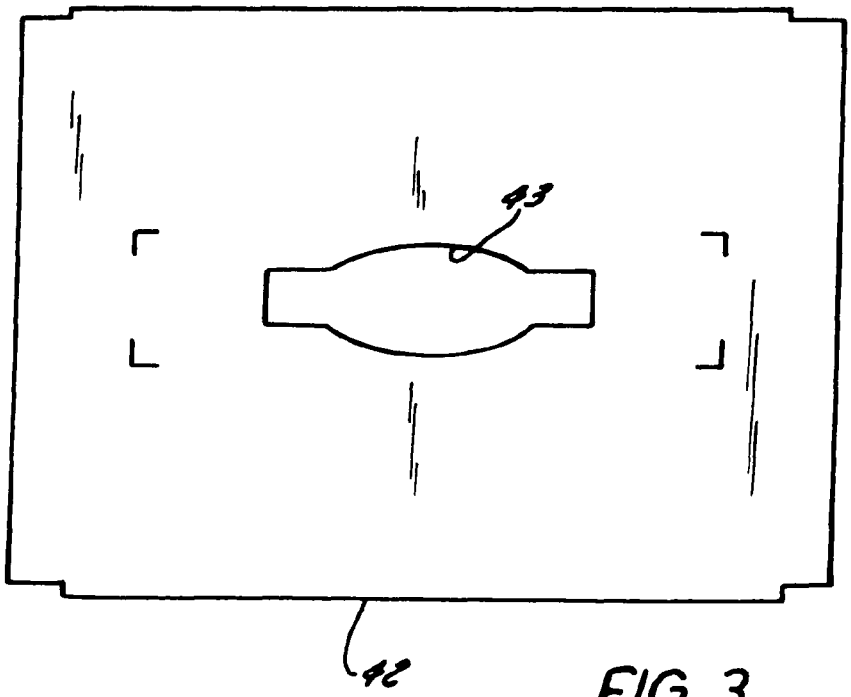
FIG. 3 is a plan view of the insert sheet used in assembling the carry handle to the lid.
Figure 8:
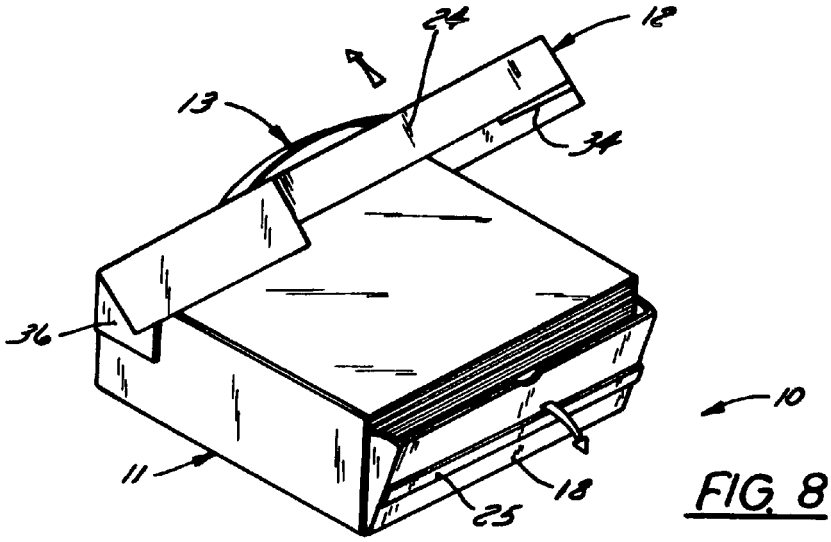
FIG. 8 is a top perspective view of the package of FIG. 7, showing the tear strip removed and the lid pivoted upwardly, with the movable front wall pivoted to a partially open position, and wherein the carton contains unwrapped sheets of paper.
Figure 9:
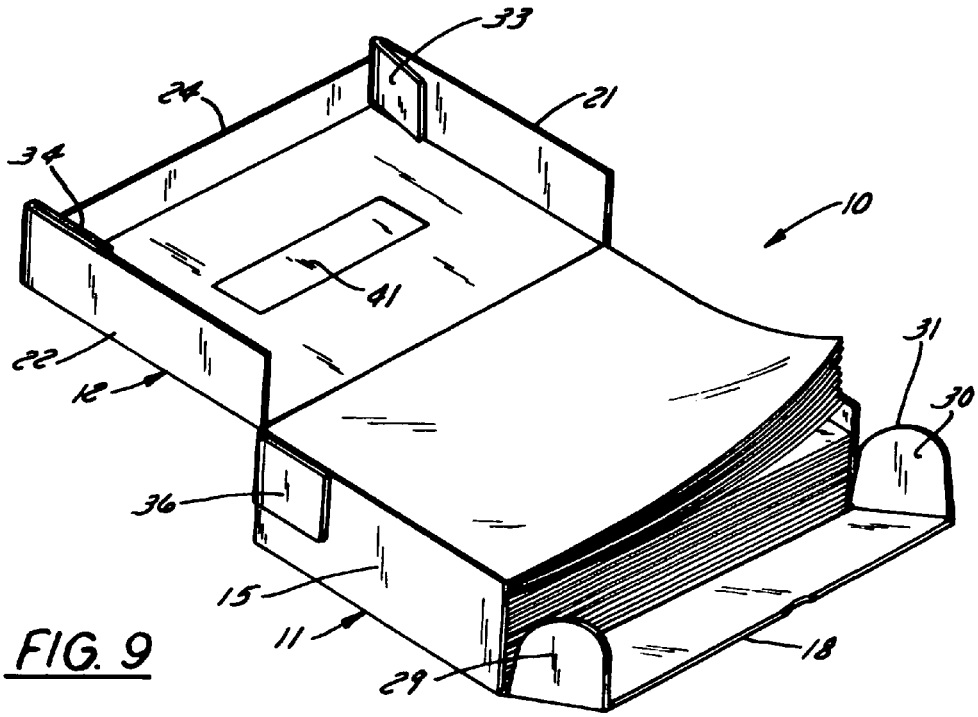
FIG. 9 is a top perspective view of the package of FIG. 8, with the lid pivoted to a fully open position and the movable front wall pivoted fully downwardly; and, FIG. 10 is a top perspective view of the package of FIG. 9, with the lid and front wall returned to their closed positions.

As seen best in FIG. 4, the first glue flaps 33 and 34 on opposite ends of the front flange panel 24 are secured by adhesive or other suitable fastening means against the inner surface of the respective end flanges 21 and 22, but the second glue flaps 35 and 36 are merely folded inwardly parallel to the end flanges and are not attached thereto. A band of adhesive 38 is applied along a bottom edge of the back flange panel 23 and a bottom edge of the second glue flaps 35 and 36 to attach these parts to the back wall and end walls, respectively, of the base portion when the lid is assembled to the base. The glue strip 25 also is adhesively attached to the base front wall, and with the band of adhesive 38 comprises the only adhesive attachment of the lid to the base portion. This permits the lid to be pivoted upwardly about the fold line L when the tear strip is removed to separate the front flange of the lid from the glue strip (see FIG. 8). That is, the end flanges 21 and 22, being free of attachment to the second glue flaps 35 and 36, are permitted to slide along the glue flaps and not resist upward movement of the lid as it is raised to its upward pivoted position.

Figure 11:
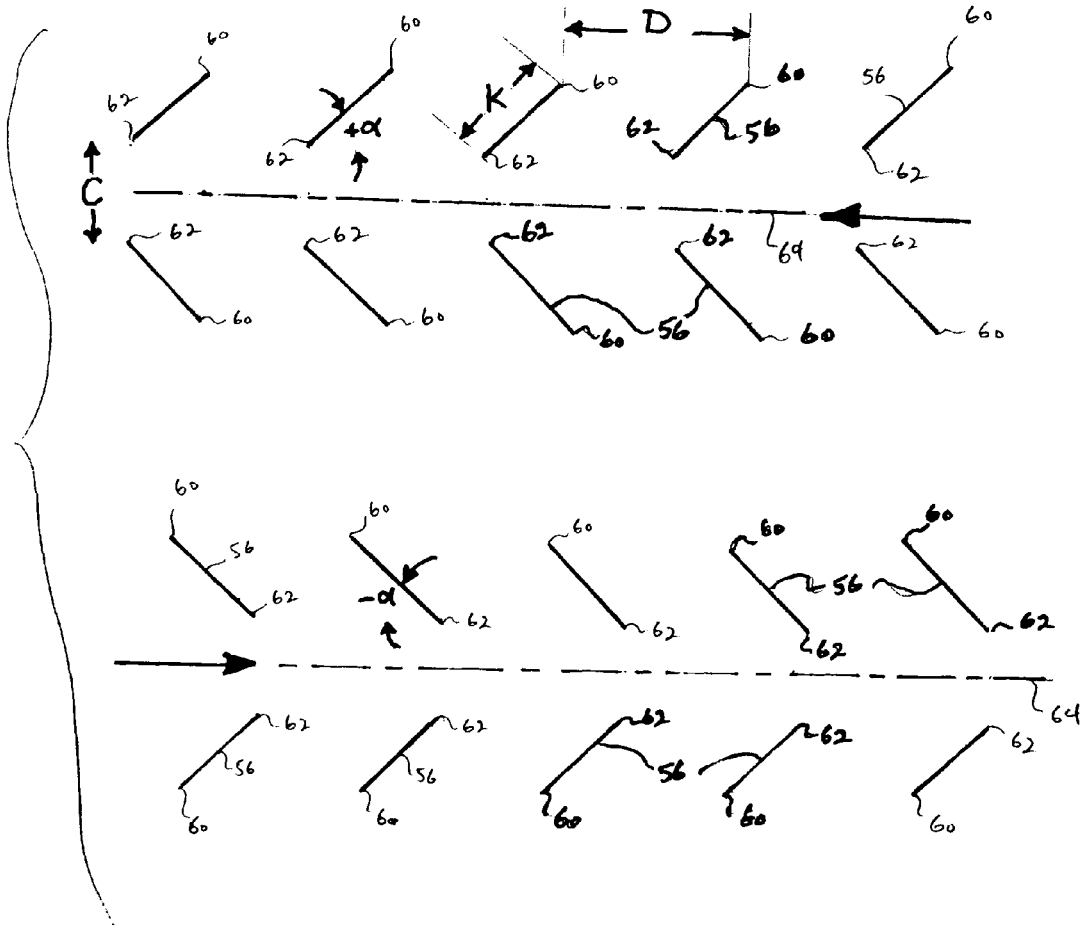
FIG. 11 is a plan view of arrangement inclined cut lines in two adjacent parallel spaced rows, thereby defining a pair of tear strips operable in opposite tearing directions, respectively.

Referring to FIGS. 2,5,7A,7B,11A and 11B, the tear strip 26 in the front flange panel 24 comprises two rows X1 and X2 of successive inclined straight cut lines 56 running lengthwise generally parallel to fold line L. The two rows of successive inclined cut lines 56 are parallel to one another and are spaced apart by a distance (C) as depicted in FIG. 11. The distance (C) can be varied from 0.25" to 1.5" depending on the configuration of the inclined cut lines 56, but in the preferred embodiment of the present invention, the distance (C) is 0.75". The inner terminal end of one cut line 24 is spaced from the outer beginning end of a successive cut line 24 by a distance (D)as measured in the direction of the tear. In this regard, and as apparent from FIGS.11A and 11B, tearing propagates from the outer beginning end of each cut line 24 inwardly toward the inner terminal end of that cut line and thence back out to the beginning end of a successive cut line 24, and so on through all of the cut lines. Each of the inclined cut lines 56 has a length (K) between the beginning and terminal ends that is positioned at a perforation angle (α) with respect to the longitudinal axis or centerline 64 of the tear strip. Depending on the length (K) and the distance (D), the angle (α) varies accordingly. The angle (α) may be 30°, 35°, 40°, and 50° degrees, but in the preferred embodiment of the present invention, the angle (α) is 45° degrees as will be described hereinafter in greater detail. In the present invention, it was discovered by the inventor that for optimum tear, the length (K) should be twice longer than the distance (D) (i.e., D=2K) so that the tear strip 26 is separated from the container 10 without molesting the front flange panel 24. In other words, the preferred D/K ratio is 2:1. However, the D/K ratio may vary with the angle (α) and ranges from 1:2 to 4:1. The D/K ratio may vary with the angle (α) and ranges from 1:1 to 3:1. The D/K ratio may vary with the angle (α) and ranges from 2:1 to 3:1. The D/K ratio may vary with the angle (α) and ranges from 1:1 to 2:1. Referring to FIGS. 11A and 11B, if the cut lines are angled upwardly and to the right at an angle (α) as shown in FIG. 11A, then the tear direction of the tear strip should be from right to left. Conversely, if the cut lines are angled upwardly and to the left at an angle (α) as shown in FIG. 11B, the tear direction of the tear strip should be from left to right. In this regard, the inwardly inclined cut lines cause tearing to propagate inwardly toward the center of the tear strip, rather than outwardly into the material of the lid flange. Inclined cut lines 56 are of any conventional form and preferably cut through the front flange panel 24 completely, although one or more of the inclined cut lines 56 may not extend through the entire thickness of the front flange panel 24, but may instead only cut partially therethrough. Although not shown, the inclined cut lines 56 can be extended to encircle the container 10 to permit complete removal of the severed portion of the container 10, if desired. The inclined cut lines 56 cooperate with one another to define the tear strip 26 where one end of the tear-strip 26 includes a pull-tab 58 for the purpose of gripping, as will be described in greater detail below. The tear-strip 26 is positioned near a centerline of the front flange panel 24.

Figure 7A:
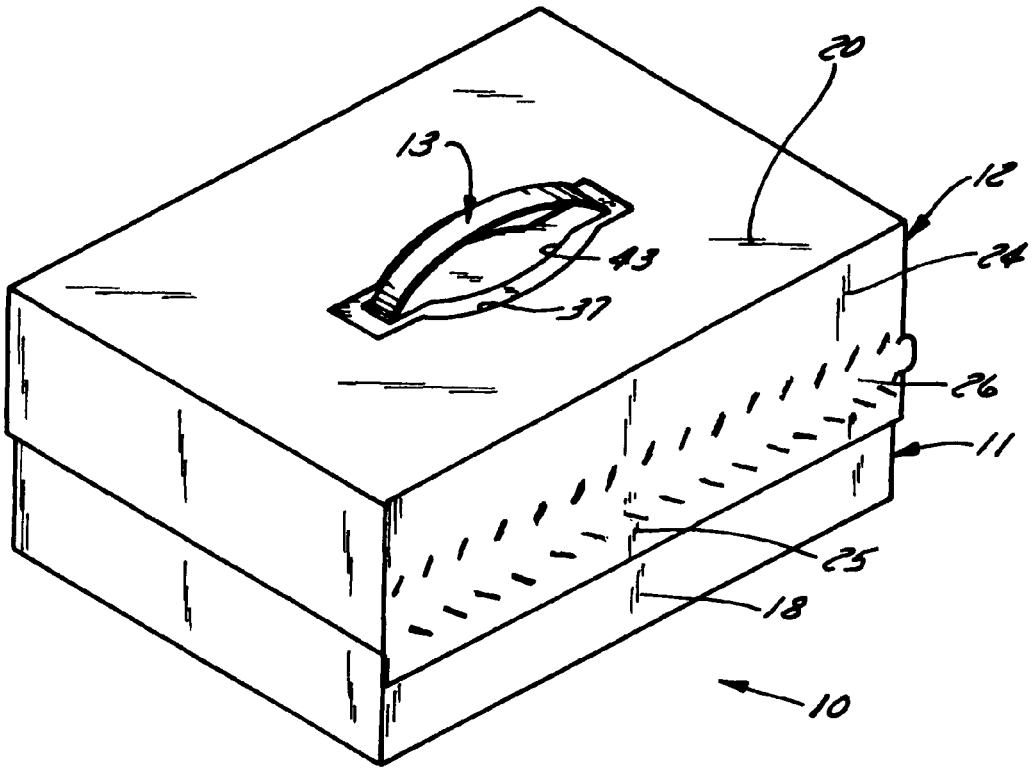
FIG. 7A is a top perspective view of a preferred package constructed in accordance with the invention.
Figure 7B:
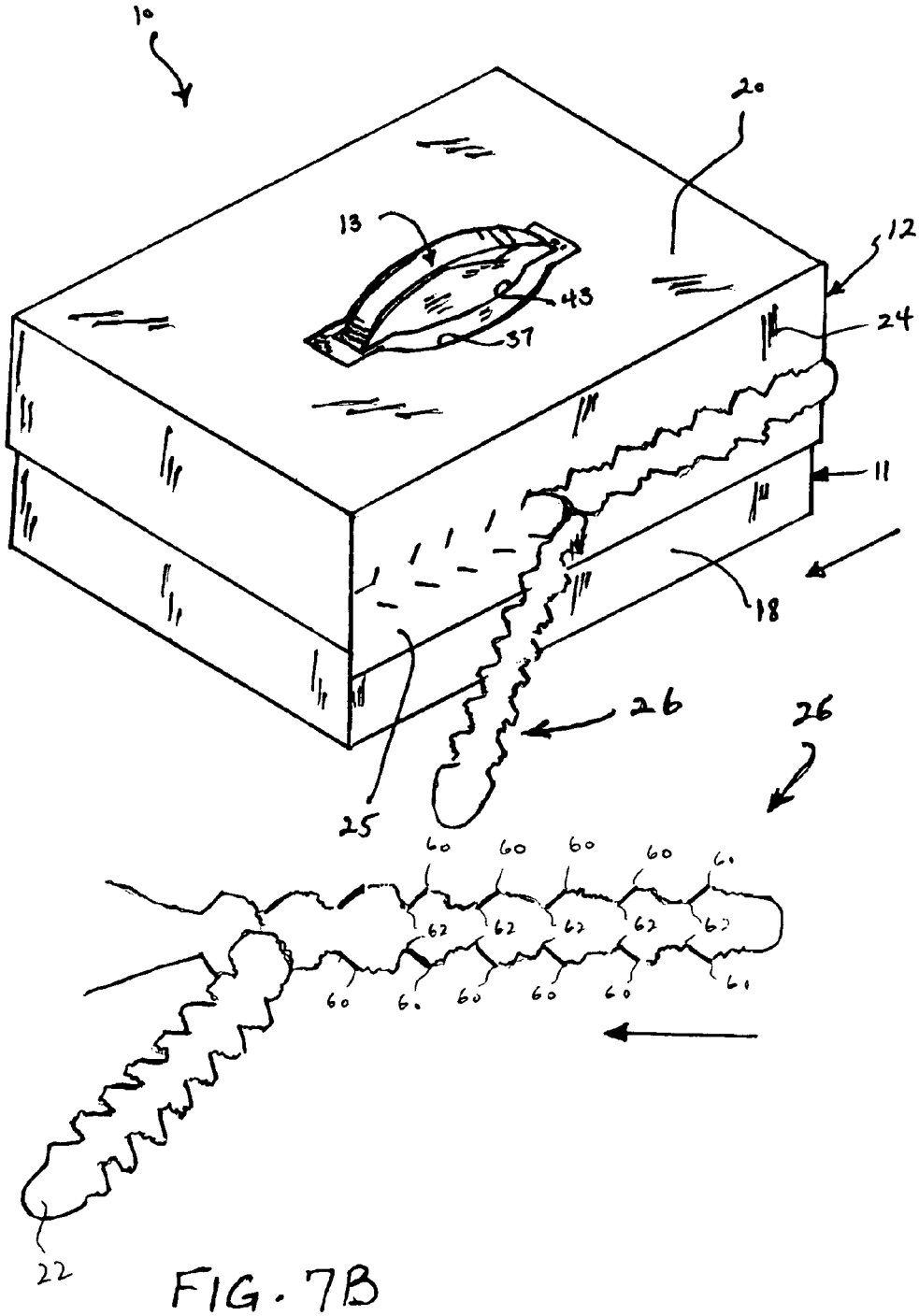
FIG. 7B is similar to FIG. 7A, illustrating the opening mechanism partially deployed.

Particularly referring to FIG. 7B in which illustrates the tear-strip 26 in accordance to a preferred embodiment of the present invention. The tear-strip 26 is defined at each of its side edges 58 by the plurality of inclined cut lines 56. The direction of tear is indicated by an arrow. The tear-strip 26 has a tab 22 at one end which is gripped by a user and pulled in an upward and forward direction, as indicated by an arrow, to remove the tear-strip 26 from the front flange panel 24. The tear strip 26 comprises at least two substantially parallel rows of inclined cut lines 56 extending along the front flange panel 24. Each of the inclined cut lines 56 comprises an initial end 60 and a terminal end 62 in which the terminal end 62 of a cut line 56 is in spatial relation with the initial end 60 of the adjacent cut line 56 whereby a tear initiated at the terminal end 62 of the cut line 56 terminates at the initial end 60 of the adjacent cut line 56 in the direction of tear as shown by the arrow.

While we do not wish to be bound by any theory, it is believed that the angle of the inclined cut line 56 with respect of the center line 64 has an effect on the extend to which a tear initiated at the terminal end 62 of the cut line 56 terminates at the initial end 60 of the adjacent cut line 56 in the direction of tear and thus the extend to which front flange panel 24 is torn or damaged. Therefore, the angle of the inclined cut line 56 with respect to the center line can vary widely provided the desired results are produced. In the preferred embodiment of the present invention, the angle of the inclined cut lines is 45° degrees with respect to the center line 64. The inclined cut line having an angle 45° degrees results in tear-strip moving in the direction of the tear without tearing or damaging the front flange panel 24 as compared to embodiments in which the inclined cut lines 56 angle is greater than or less than 45° degrees. However, depending on the design of the tear-strip, other angles such as 25°, 30°, 35°, 40°, and 50° degrees are also within the scope of the present invention. In general, it will be appreciated that the practice of this invention is not limited to 45° degree angle, and, depending on the needs of a user, the inclined cut lines 56 can be any number of degrees as the design of the tear strip 26 permits.

In use, as the tear-strip 26 is pulled from the front flange panel 24, the cut portions readily separate. When the tear-strip 26 is pulled, pulling force is applied to the portion of the front flange panel 24 beyond the respective initial and terminal ends 60, 62 of each cut line 56, and the tear-strip 26 is detached. In this connection, the terminal end portion of each cut line 56 slopes towards the next following cut line 56 so that tear is initiated in a direction towards the next following cut line 56. At the same time, it will be noted that the initial end 60 of the next following cut line to the one where tear is being initiated has been reached by the tear-strip 26 in the direction of tear so that no tear force is required at the next following cut line 56 as the tear-strip 26 is pulled and substantially all the force of the pull is applied to the tear initiation at the terminal end 62 of the cut line. The tear proceeds and is completed along an edge substantially like the edge 58 under normal conditions of tearing as the paperboard shears from back to front and the tear-strip 26.

Figure 10:
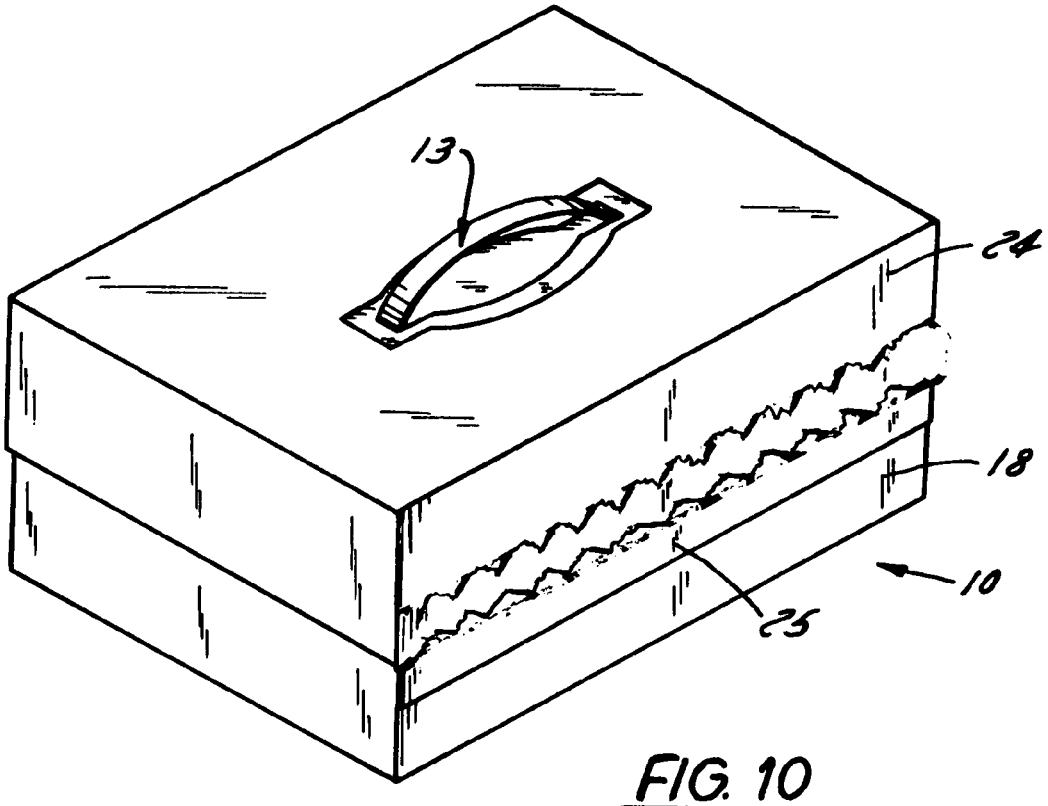

After the tear strip 26 had been removed from the front flange panel 24, lid 12 may be pivoted about opposing sidewall panel 22 of the container 10, thereby exposing the open upper end of the main body portion 14 so that items may be removed therefrom. Lid 12 may be positioned back over the open upper end of the main body portion 11, thereby reclosing the container 10 for safekeeping of unused items as depicted in FIG. 10. Optionally, if a tear strip has been provided in both sidewall panels of the container 10, the lid 12 may be removed entirely from the main body portion 11, as will be obvious to those of ordinary skill in the art, upon reading the within disclosure.

Figure 5:
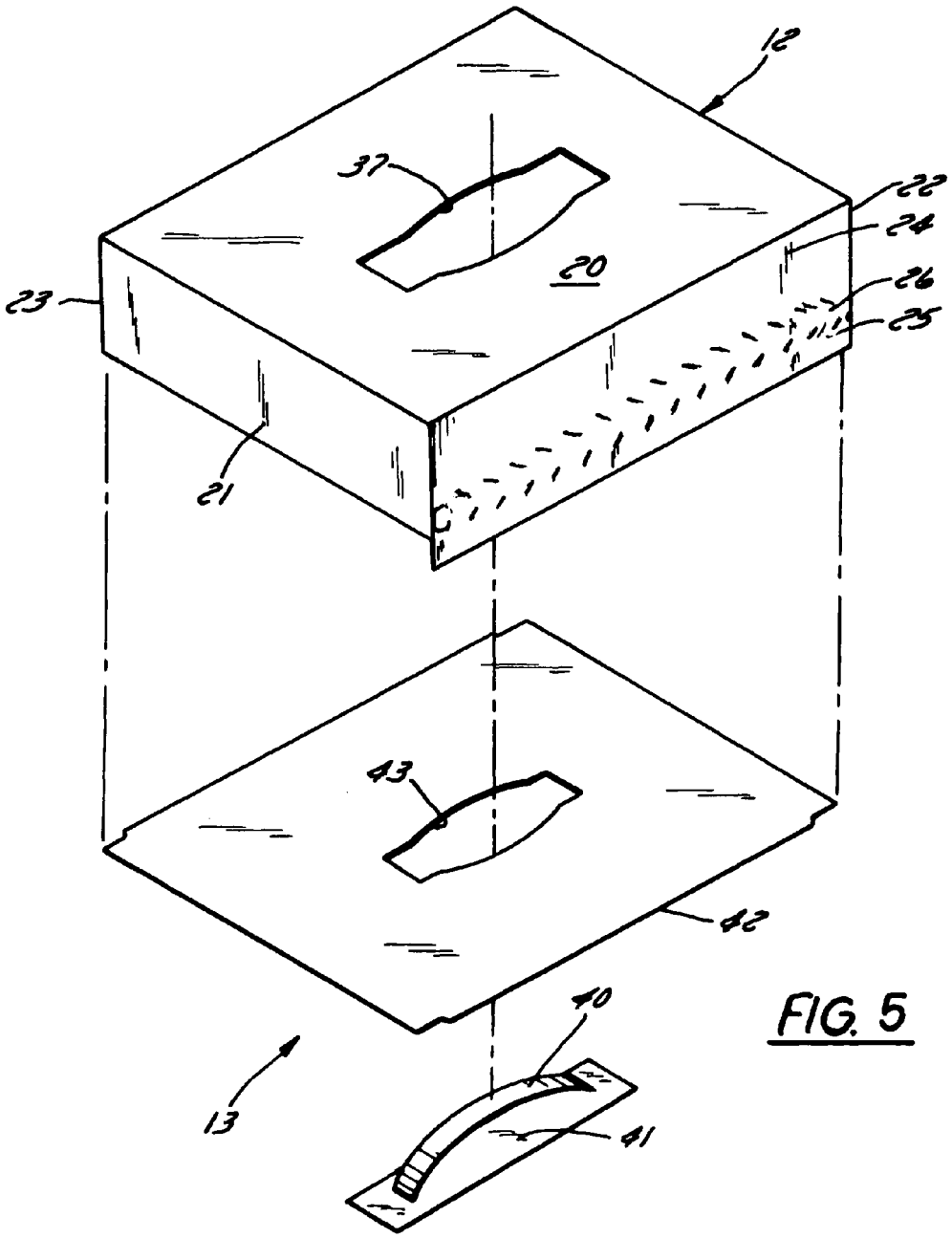
FIG. 5 is an exploded top perspective view of the lid and carries handle assembly of the carton of the invention.

As seen best in FIG. 5, the carry handle 13 includes a flexible strap 40 attached to a rectangular base plate 41 that is adhesively attached to the bottom of an insert sheet 42 sized to fit in the lid beneath the top wall, with the strap projecting through a shaped opening 43 in the sheet 42 and through the shaped opening 37 in the lid top wall. The sheet 42 may be adhesively attached to the underside of the lid top wall, or merely fit into the lid between the top wall and the paper sheets without being attached to the top wall. Either way, this construction results in a very strong carry handle.

As seen in FIGS. 7-10, the package is compact, enabling it to be easily stored under a desk or on a shelf. Opening of the package is easily accomplished simply by removing the tear strip and pivoting the lid upwardly, after which the front wall can be pivoted downwardly to gain access to the paper held in the carton. After the desired amount of paper has been removed, the front wall can be returned to its upright position, with the tuck-in flaps inserted between the base end walls and the paper held in the carton, and the lid returned to its lowered position to close the package and hold the front wall in its closed position.

While the invention has been shown for holding unwrapped sheets of paper, it should be understood that it could be used for holding wrapped reams of paper, and although the preferred embodiment is designed for holding about three reams of paper, the carton could be sized for holding other quantities of paper so long as the size and weight do not exceed amounts (for example, about 20 pounds) that provide ease of handling and carrying by the carry handle.

While particular embodiments of the invention have been illustrated and described in detail herein, it should be understood that various changes and modifications may be made to the invention without departing from the spirit and intent of the invention as defined by the scope of the appended claims.

What is claimed is:

1. A carton for shipping and storing a quantity of cut sheets of paper, comprising:

a carton base portion having a bottom wall, opposed upstanding front and back walls and opposed upstanding end walls, each joined along a bottom edge to a respective edge of the bottom wall, and an open top;

a lid telescopically engaged over the open top, said lid having a top wall with depending end flanges, a depending back flange foldably connected to the lid top wall and attached to the carton back wall, and a depending front flange, said depending front flange comprising a tear strip having a longitudinal axis and being defined by two spaced apart parallel rows of successive straight inclined cut lines wherein the parallel rows of successive straight inclined cut lines being symmetrical with one another with respect to the longitudinal axis, the tear strip includes a tab which upon tearing moves in direction of convergence of the inclined cut lines, each of the inclined cut lines having an outer beginning end and an inner terminal end, whereby tearing propagates inwardly along a cut line from its outer beginning end to its inner terminal end and then outwardly to the beginning end of a successive cut line, said cut lines having a length (K) between the beginning and terminal ends, and the terminal end of one cut line being spaced from the beginning end of a succeeding cut line by a distance (D) as measured in a direction parallel to the longitudinal axis of the tear strip, wherein the ratio of D/K is from 1:1 to 4:1;

said base portion front wall being unsecured to adjoining end walls and being pivotable about its bottom edge downwardly and away from the carton to an open position when the lid is moved upwardly away from said front wall, thereby exposing the cut paper at the top and one side to permit easy access to paper contained in the carton for rapid unloading of the paper from the carton;

said front wall having inwardly turned tuck-in flaps on opposite ends thereof which tuck into the carton in contiguous, parallel, overlapping relationship with adjacent end walls when said front wall is in closed position; and said inwardly turned glue flaps being on opposite ends of said lid front flange and said lid back flange, said glue flaps on said lid front flange being attached to respective said lid end flanges, and said glue flaps on said lid back flange being free of attachment to said lid end flanges and wherein said glue flaps on said lid back flange are attached to respective said base portion end walls.

2. The carton as claimed in claim 1, wherein the ratio of D/K is from 1:1 to 3:1.

3. The carton as claimed in claim 1, wherein the ratio of D/K is from 2:1 to 3:1.

4. The carton as claimed in claim 1, wherein the incline cut lines diverge at perforation angles ranging from 30° to 50° degrees with respect to the longitudinal axis of the tear strip.

5. The carton as claimed in claim 1, wherein the incline cut lines diverge at a perforation angle of 45° degrees with respect to the longitudinal axis of the tear strip.

6. The carton as claimed in claim 1, further comprising a handle affixed to said lid to facilitate carrying of said package.

7. The carton as claimed in claim 1, wherein:

a bottom edge of said lid back flange and a bottom edge of said glue flaps on said lid back flange are attached to said base portion back wall and end walls, respectively.

8. The carton as claimed in claim 1, wherein:

a glue strip extends along a bottom edge of said lid front flange, said glue strip being attached to said base portion front wall.

9. The carton as claimed in claim 1, wherein:

the tuck-in flaps on said base portion front wall are relatively narrow so that they may be moved into and out of the carton without unduly disturbing the contents of the carton.

10. The carton as claimed in claim 1, wherein:

said lid top wall is foldably attached to said lid back flange along a fold line, and said lid pivots upwardly about said fold line.

11. The carton as claimed in claim 10, wherein:

said lid is attached to said base portion only by attachment of said lid back flange to said base portion back wall, attachment of said lid back flange glue flaps to said base portion end walls, and attachment of said glue strip to said base portion front wall.

12. A blank for making a lid portion of a carton for shipping and storing a quantity of cut sheets of paper, comprising:

a rectangular lid top wall panel;

opposite lid end flange panels foldably attached to opposite ends of said top wall panel;

a lid back flange panel foldably attached to a back edge of said top wall panel;

glue flap panels foldably attached to opposite side edges of said back flange panel;

a lid front flange panel foldably attached along one edge to a front edge of said top wall panel, the front flange panel comprising a tear strip having a longitudinal axis and being defined by two parallel spaced apart rows of successive inclined cut lines wherein the parallel rows of successive straight inclined cut lines being symmetrical with one another with respect to the longitudinal axis, the tear strip includes a tab which upon tearing moves in direction of convergence of the inclined cut lines, each of the inclined cut lines having an outer beginning end and an inner terminal end and a length (K) between the beginning and terminal ends, the terminal end of one cut line being spaced from the beginning end of a succeeding cut line by a distance (D) as measured in a direction parallel to the longitudinal axis of the tear strip, wherein the ratio of D/K is from 1:2 to 4:1;

glue flap panels foldably attached to opposite side edges of said front flange panel, said glue flaps being on opposite ends of said lid front flange and said lid back flange, said glue flaps on said lid front flange being attached to respective said lid end flanges, and said glue flaps on said lid back flange being free of attachment to said lid end flanges; and a glue strip panel removably attached by a tear strip to an edge of said front flange panel opposite said one edge.

13. A lid for placement over an open end of a container to close the open end, said lid comprising:

a lid top wall having an opening therethrough and depending front and back flange panel and end flange panel; the front flange panel comprising a tear strip having a longitudinal axis and being defined by two parallel rows of successive inclined straight cut lines wherein the parallel rows of successive straight inclined cut lines being symmetrical with one another with respect to the longitudinal axis, the tear strip includes a tab which upon tearing moves in direction of convergence of the inclined cut lines, each of the inclined cut lines having an outer beginning end and an inner terminal end and a length (K) between the beginning and terminal ends and further being spaced apart by a distance (D) as measured in a direction parallel to the longitudinal axis of the tear strip, wherein the ratio of D/K is from 1:2 to 4:1;

an insert panel beneath said top wall, said insert panel having an opening therethrough in alignment with the opening through the top wall; and a flexible strap attached at opposite ends to a base plate beneath said insert panel, said strap projecting through said aligned openings in said insert panel and top wall and forming a carry handle and wherein glue flaps are on opposite ends of said front flange, said glue flaps attached to said end flanges, and glue flaps are on opposite ends of said back flange, said glue flaps being free of attachment to said end flanges.

* * * * *